US008282034B1

(12) United States Patent
Channel et al.

(10) Patent No.: US 8,282,034 B1
(45) Date of Patent: Oct. 9, 2012

(54) MULTIPLE ROLL TOILET PAPER HOLDER AND DISPENSER

(76) Inventors: Roy Channel, Ottawa, KS (US); Betty Channel, Ottawa, KS (US)

( * ) Notice: Subject to any disclaimer, the term of this patent is extended or adjusted under 35 U.S.C. 154(b) by 0 days.

(21) Appl. No.: 13/274,634

(22) Filed: Oct. 17, 2011

Related U.S. Application Data

(60) Provisional application No. 61/452,689, filed on Mar. 15, 2011.

(51) Int. Cl.
*B65H 16/04* (2006.01)

(52) U.S. Cl. ..... 242/597.3; 242/597.5; 242/597.7

(58) Field of Classification Search ..... 242/597, 242/597.1, 597.2, 597.3, 597.7, 560, 560.2, 242/597.5, 597.6
See application file for complete search history.

(56) References Cited

U.S. PATENT DOCUMENTS 1,670,120 A * 5/1928 Melling ..... 242/597.2
2,944,749 A * 7/1960 Maier ..... 242/597.3
2,991,951 A * 7/1961 Carroll ..... 242/560.2
3,612,423 A * 10/1971 Bahnsen ..... 242/560.2
3,829,034 A * 8/1974 Mickelson ..... 242/597.3
4,322,042 A * 3/1982 Wormly ..... 242/560.2
4,432,451 A 2/1984 Hooser
4,463,912 A 8/1984 Grunerud
4,607,809 A 8/1986 Sineni
4,765,475 A 8/1988 Kaysserian
4,767,074 A * 8/1988 Bower ..... 242/597.3
5,887,818 A 3/1999 Kelley
7,264,196 B2 * 9/2007 Guay et al. ..... 242/597.2

* cited by examiner

*Primary Examiner* — William A Rivera
(74) *Attorney, Agent, or Firm* — Danel Boudwin; Alex Boyer

(57) ABSTRACT

Disclosed is a device and method for storing and dispensing multiple rolls of toilet paper. The present invention comprises a weighted base with an elongated vertical body, onto which several rolls of toilet paper can be placed. The top portion of the elongated body pivots, and can lock in a vertical position, allowing for storage of additional rolls of toilet paper. The top portion can also lock into a horizontal position for use of a toilet paper roll mounted thereon. Once a roll of toilet paper is depleted, a user slides a replacement roll up the vertical body, and over the pivot, where it rests on the top portion.

8 Claims, 2 Drawing Sheets

MULTIPLE ROLL TOILET PAPER HOLDER AND DISPENSER

CROSS REFERENCE TO RELATED APPLICATION

This application claims the benefit of U.S. Provisional Application

No. 61/452,689 filed on Mar. 15$^{th}$, 2011, entitled "TP Holder."

BACKGROUND OF THE INVENTION

1. Field of the Invention

The present invention relates to a toilet paper roll holder. More specifically, the present invention pertains to an improved toilet paper roll dispenser and holder for residential use that stores multiple rolls of toilet paper and allows for easy replacement of toilet paper rolls when a new roll is required.

Toilet paper is a soft type of paper product used to maintain personal hygiene. It is distinguishable from facial tissue because toilet paper is designed to decompose in a septic tank. Toilet paper comes in a wide variety of plys, colors, and scents. Regardless of type, virtually all toilet paper is wrapped on a cardboard tube.

Toilet paper holders are found in virtually every home in the United States. A traditional toilet paper dispenser is designed to hold only one roll of toilet paper. This requires a storage location for additional rolls, and requires checking to make sure there is sufficient toilet paper in the dispenser prior to use. In addition, traditional toilet paper dispensers are constructed with retractable sides and spring-loaded mechanisms in their center. This design causes problems for users who have difficulty grasping and controlling the sides. Such individuals may need assistance in replacing toilet paper rolls.

The present invention is designed to give consumers an easily accessible place to store multiple rolls of toilet paper for when their current roll is emptied, and allows consumers to easily replace a new roll. The design contains a toilet paper dispenser with a weighted base and an elongated vertical body, onto which several rolls of toilet paper can be placed. The top portion of the elongated body pivots, and may be locked at a vertical position, allowing for storage of new rolls of toilet paper, or may be locked at a horizontal position for dispensation of the toilet paper for use. Once a roll of toilet paper is depleted, users slide a replacement roll up the vertical body, over the pivot, where it rests on the horizontal body.

2. Description of the Prior Art

There are several toilet paper holders in the prior art that are designed to hold more than one roll of toilet paper. For example, Grunerud, U.S. Pat. No. 4,463,912 discloses a dispenser for toilet paper. The dispenser has a storage container which allows a plurality of rolls to be stored in an end-to-end stack arrangement. The lowest roll can be dispensed by a user through a side opening in the storage container. When the lowest roll is completely used, the user can discharge the roll core by pulling a slide plate outwardly to align an aperture in the slide plate with the used core. Devices such as this are intended for use in public bathrooms, where theft of toilet paper rolls is of greater concern than ease of use. These designs are not suitable for residential settings.

Other devices disclosed in the prior art are designed only to store extra rolls of toilet paper. Hooser, U.S. Pat. No. 4,432,451 discloses a bathroom accessory in the form of a canister for convenient storage of extra rolls of toilet paper and a suction type device. Such devices are not intended to dispense toilet paper, therefore requiring a separate dispenser.

Several devices designed for the home function both as storage containers and as toilet paper dispensers. Kelley, U.S. Pat. No. 5,887,818 discloses a device and method for dispensing and storing multiple rolls toilet paper, which has a storage frame configured to hold multiple rolls on a generally vertical shaft. The shaft extends upward from the bottom of the frame with the uppermost roll of material being freely accessible for use on the shaft. A lifting assembly is slideably secured to the shaft and positioned below the bottom roll of rolled material. Kaysserian, U.S. Pat. No. 4,765,475 discloses a container for storing and dispensing a plurality of rolls of tissue stacked vertically adjacent to one another and includes tubular side walls. Sineni, U.S. Pat. No. 4,607,809 discloses a toilet paper holder and roll dispenser for residential use that includes an enclosed, vertically tubular body that receives the rolls, with a bracket adapted to fit over the top rim of a conventional residential toilet tank under the tank cover without the need for any special fasteners or wall damage. An actuator rod is slideable in axial slots in the body to shift the rolls upwardly so that the top roll may be easily removed, and the rod may be locked in any desired position by simply rotating the rod 90 degrees. While these devices are designed for the home, they store extra rolls of toilet paper inside a canister, and use complicated mechanisms to remove toilet paper rolls. This can cause difficulty for some users when accessing additional rolls.

The devices in the prior art are designed for commercial applications, and are not suitable for use by those who have difficulty replacing toilet paper rolls on traditional dispensers. The present invention is designed for use by all individuals, particularly children, elderly persons, and other individuals who may have difficulty replacing toilet paper rolls on traditional dispensers. It substantially diverges in design elements from the prior art and consequently it is clear that there is a need in the art for an improvement to existing toilet paper holders and dispensers. In this regard the instant invention substantially fulfills this need.

SUMMARY OF THE INVENTION

In view of the foregoing disadvantages inherent in the known types of toilet paper holders and dispensers now present in the prior art, the present invention provides a new toilet paper holder and dispenser wherein the same can be utilized for providing convenience for the user when dispensing and using toilet paper.

It is therefore an object of the present invention to provide a new and improved toilet paper holder and dispenser device that has all of the advantages of the prior art and none of the disadvantages.

Another object of the present invention is to provide a device that provides convenient storage and use of multiple rolls of toilet paper.

Another object of the present invention is to provide a portable, free standing toilet paper holder and dispenser that can be positioned by an individual user as desired.

Yet another object of the present invention is to provide a toilet paper holder and dispenser that permits easy removal of the cardboard tube that remains after a roll of toilet paper is used.

Still another object of the present invention is to provide a toilet paper holder and dispenser that permits easy replacement of a roll of toilet paper with one that is stored on the dispenser for those who have difficulty with conventional toilet paper dispensers.

Another object of the present invention is to provide a toilet paper holder and dispenser that permits accessibility to the toilet paper roll being used.

Yet another object of the present invention is to provide a toilet paper holder and dispenser that permits easy detection of the number of rolls of toilet paper remaining.

A final object of the present invention is to provide a toilet paper holder and dispenser that provides a low cost, simple and reliable solution to the known problems of toilet paper dispensers and holders.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
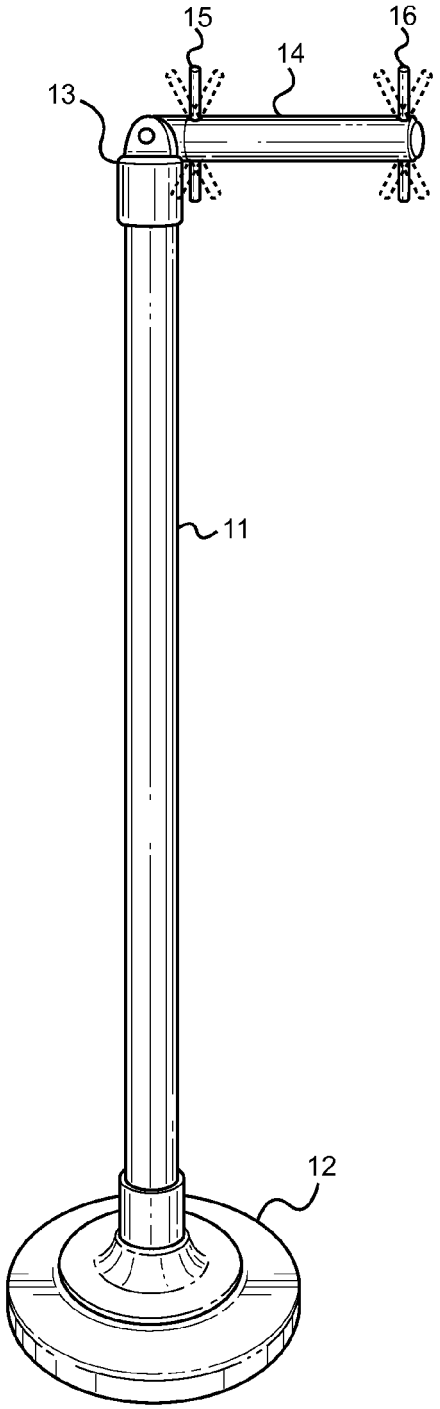
FIG. 1 shows a perspective view of the present invention in a horizontal position, including a vertical elongated body, base, pivoting means, horizontal upper portion, inner roll retainer and outer roll retainer.

Reference is made herein to the attached drawings. Like reference numerals are used throughout the drawings to depict like or similar elements of the toilet paper roll holder. For the purposes of presenting a brief and clear description of the present invention, the preferred embodiment will be discussed as used for removably retaining toilet paper rolls in use and in storage. The figures are intended for representative purposes only and should not be considered to be limiting in any respect.

Referring now to FIG. 1, there is shown a perspective view of the present invention, comprising a vertical elongated body 11, a base 12, a pivoting means 13, a horizontal upper portion 14, an inner roll retainer 15 and an outer roll retainer 16. The base 12 is attached to the vertical elongated body 11 and provides a weighted platform to support the device, associated toilet paper rolls and further attachments. The overall height of the vertical body 11 makes the design susceptible to tipping over. To prevent this, the base 12 must be sufficiently weighted avoid movement of the vertical body 11 when in use and lifting of the base 12 from a flat, prone position. The vertical body 11 comprises a round structure, and has a diameter that is less than that of a standard cardboard tube toilet paper roll. The vertical body 11 is ideally suited to allow multiple rolls of toilet paper to be stored thereon, therefore the vertical body 11 must be of sufficient length to accommodate a number of rolls desired by the user, while still providing a working position that is suited for use while in a seated position.

Figure 2:
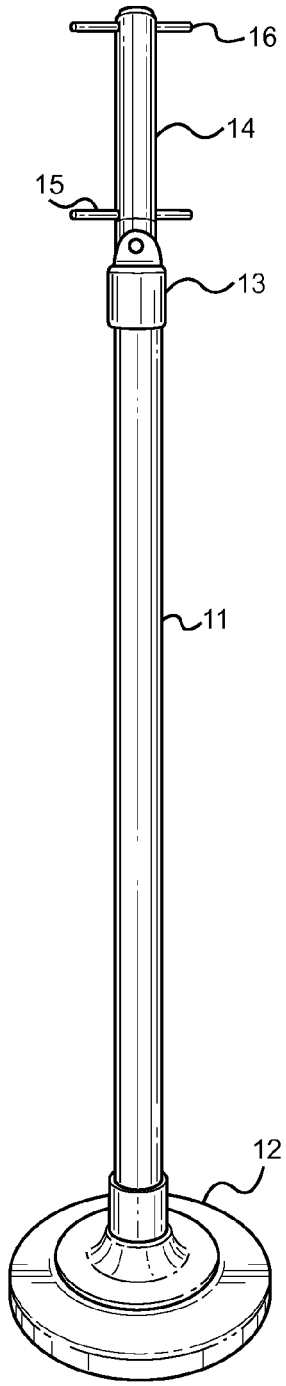
FIG. 2 shows a perspective view of the present invention in a vertical position including a vertical elongated body, base, pivoting means, vertical upper portion, inner roll retainer and outer roll retainer.

The top of the vertical body 11 comprises a pivoting means 13 and a pivoting upper portion 14. The upper portion 14 is adapted to hold a single roll of toilet paper that is ready for use. The pivoting means 13 is a hinged joint that allows the upper portion 14 to be placed in a vertical position as seen in FIG. 2, or a horizontal position as seen in FIG. 1. The hinged portion of the pivoting means 13 comprises a revolute joint that allows the upper portion 14 to pivot 180 degrees, from one horizontal position to an opposing horizontal.

The inner roll retainer 15 and outer roll retainer 16 are both flexible, cantilevered structures that can fold towards the upper portion 14 terminal end or away from its terminal end under shearing load exerted by a toilet paper roll. The inner roll retainer 15 and outer roll retainer 16 positionally hold the toilet paper in a working position, and fold to allow a roll of toilet paper to pass over them when a sufficient force is applied thereto. The inner roll retainer 15 prevents the roll of toilet paper from sliding down the vertical body 11, while the outer roll retainer 16 prevents the roll of toilet paper from sliding off the end of the upper portion while in use. When a roll of toilet paper is depleted, the empty cardboard tube slides over the upper portion 14 and makes contact with the outer roll retainer 16. The outer roll retainer 16 folds towards the end of the upper portion and the tube passes over the outer roll retainer 16, allowing removal of the tube from the upper portion 14. The flexibility of the retainers allows their use when in an extended position, while also allowing a roll of toilet paper to pass thereover via retainer deflection and without requiring their removal.

Referring now to FIG. 2, there is shown a perspective view of the present invention in the vertical position. In this orientation, the pivoting means 13 is positioned vertically, placing the upper portion 14 in alignment with the vertical body 13. From the vertical position, the outer roll retainer 16 and inner roll retainer 15 fold, allowing storage or removal of toilet paper rolls from the vertical body 11. The hinge portion of the pivoting means 13 may further provide a locking detent for locking the upper portion 14 in a vertical or horizontal position, keeping the upper portion 14 in a static position to allow for ease of use when storing, removing or utilizing the toilet paper.

Figure 3:
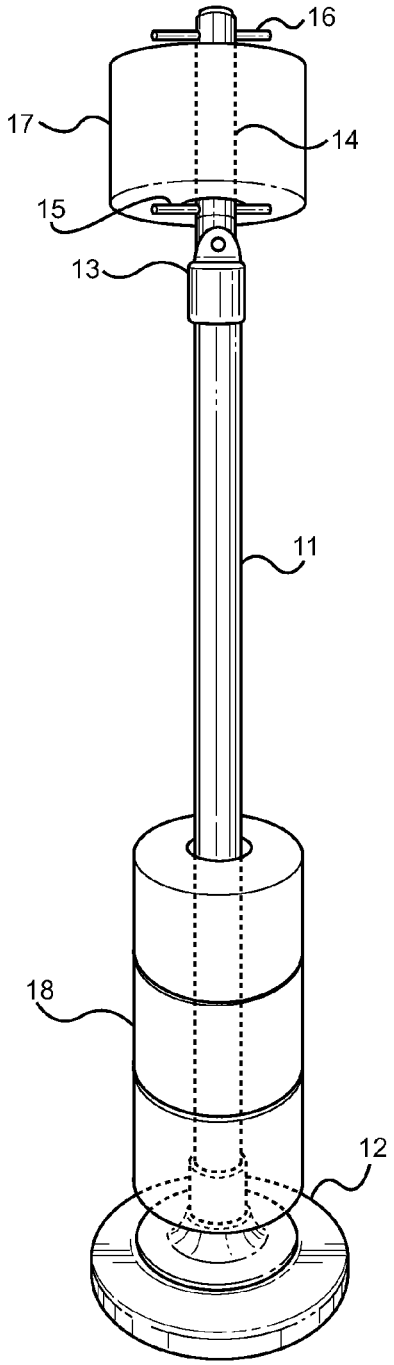
FIG. 3 shows a perspective view of the present invention in a vertical position with a roll of toilet paper mounted to the upper portion and three rolls of toilet paper in the storage position.

Referring now to FIG. 3, there is shown a perspective view of the present invention in the vertical position with three rolls of toilet paper 18 in a storage position and one roll of toilet paper 17 in a working position. To store toilet paper on the device, the outer 16 and inner 15 roll retainers fold, and the pivoting means 13 locks in the vertical position. Toilet paper rolls 18 are then slid over the upper portion 14, over the pivoting means 13, down the length of the vertical body 11. The toilet paper rolls then rest on top of the base 12 and are stacked accordingly.

There are two methods of replacing a roll of toilet paper and placing a roll in a working position 17. To move a roll from the storage position 18 to the working position 17, a user locks the pivoting means 13 in the vertical position. The cardboard tube from the previously used roll of toilet paper is removed from the upper portion 14. A roll from the storage position is moved up the vertical body 11, over the pivoting means 13 and comes to rest on the upper portion 14, directly under the outer roll retainer 16. Finally, the pivoting means 13 is placed in the working position as shown in FIG. 4.

An alternative method of placing a roll of toilet paper in a working position 17 is to add a new roll from an external source. A user locks the pivoting means 13 in the vertical position, and the cardboard tube from the previously used roll of toilet paper is removed from the upper portion 14. A new roll slides over the upper portion 14 and rests at the inner roll retainer 15. The pivoting means 13 is placed in a horizontal working position as shown in FIG. 4. A further option is for the user to leave the pivoting means 13 in the horizontal working position, and slide a new roll onto the upper portion 14.

Figure 4:
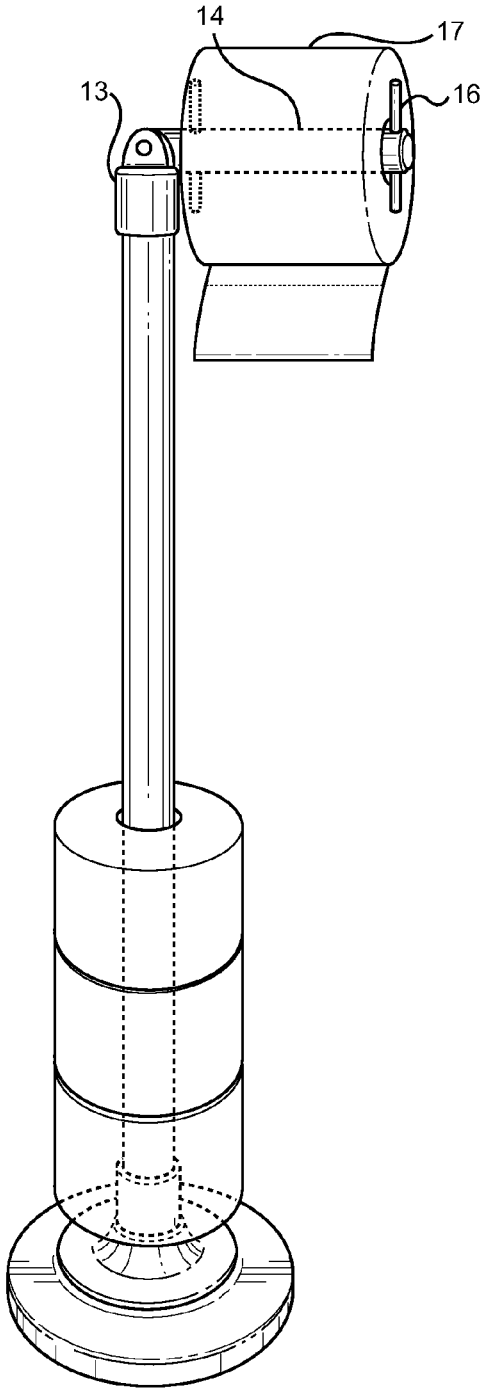
FIG. 4 shows a perspective view of the present invention in a horizontal position with a roll of toilet paper in a working position along the upper portion and three rolls of toilet paper in the storage position.

Referring now to FIG. 4, there is shown a perspective view of the present invention in a horizontal position, wherein three rolls of toilet paper 18 are placed in a storage position and one roll of toilet paper 17 is placed in the working position. The roll in the working position 17 spins on the upper portion 14, allowing a user to remove toilet paper from the roll. The pivoting means 13 locks the upper portion 14 in the horizontal position detent, allowing access to the roll 17. When the working roll 17 is empty, the cardboard tube is removed, and a new roll is replaced by either of the previously mentioned methods for replacing a new roll.

In the preferred embodiment, the present invention is constructed of a metallic material for improved weight of the base and easy cleaning. In an alternative embodiment, the device can be constructed from plastic, wood, or a similar material. A further alternative embodiment encompasses a magazine holder or sanitizing wipe holder being positioned into the base of the device, wherein a rack is provided that functions to hold either product for a user occupying a nearby space. The holder may encompass any rectangularly flanged holder that can support upright magazines or a wipe container in a position adjacent to stowed rollers along the vertical body 11. In yet another alternative embodiment, the inner roll retainer 15 and outer roll retainer 16 may also be removable. The means for removing the retainers include tapped holes and threaded engagement of the retainers, a simple through hole and singular retainer that is pushed therethrough, or finally a depressible retainer that is spring loaded within the upper portion 14 body.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toilet paper dispenser for holding and dispensing a plurality of rolls of toilet paper comprising:

an elongated, vertical body with a first and second end;

said elongated body first end being connected to a base;

said elongated body second end having a pivoting means attached to an upper portion, allowing said upper portion to be pivoted between a vertical position and a horizontal position, wherein a roll of toilet paper having a first and second end is held on said upper portion by a plurality of flexible retainers engaging said first and second ends of said roll of toilet paper, said flexible retainers are capable of bending toward and away from said pivoting means.

2. A device as in claim 1, wherein said elongated body has a diameter that is less than the diameter of a hollow cardboard tube containing said toilet paper.

3. A device as in claim 1, wherein said upper portion has an axial length at least as great as a roll of toilet paper.

4. A device as in claim 1, wherein said plurality of retainers are removable to allow said roll of toilet paper to be received or dispensed.

5. A device as in claim 4, wherein said removable retainers comprise a single retainer that fits through a hole within said upper portion.

6. A method of placing toilet paper rolls on a toilet paper dispenser, comprising the steps of:

locking a pivoting means in a vertical position aligning it with a vertical lower body, sliding said rolls of toilet paper down an upper portion, over a plurality of flexible retainers, over said pivoting means, down said vertical lower body, resting on top of a base.

7. A method of placing a new roll of toilet paper on a toilet paper dispenser, comprising the steps of:

locking a pivoting means in a vertical position, removing a cardboard tube from a previously used roll of toilet paper, moving said roll of toilet paper from a storage position up a vertical body, over said pivoting means, coming to rest on an upper portion between a first flexible retainer are and a second flexible retainer.

8. The method of claim 7, further comprising:

placing said pivoting means in a horizontal position after positioning said roll of toilet paper comes to rest on said upper portion.

* * * * *